US009370220B2

(12) United States Patent
Slingluff

(10) Patent No.: US 9,370,220 B2
(45) Date of Patent: Jun. 21, 2016

(54) BOOT WITH MODIFIED ORIENTATION IN TOE REGION

(76) Inventor: Peter Slingluff, Allston, MA (US)

( * ) Notice: Subject to any disclaimer, the term of this patent is extended or adjusted under 35 U.S.C. 154(b) by 129 days.

(21) Appl. No.: 13/565,737

(22) Filed: Aug. 2, 2012

(65) Prior Publication Data

US 2013/0031806 A1 Feb. 7, 2013

Related U.S. Application Data

(60) Provisional application No. 61/515,584, filed on Aug. 5, 2011.

(51) Int. Cl.

| | |
|---|---|
| ***A43B 13/14*** | (2006.01) |
| ***A43B 7/14*** | (2006.01) |
| ***A43B 5/04*** | (2006.01) |
| ***A43B 17/02*** | (2006.01) |

(52) U.S. Cl.

CPC ..... *A43B 7/145* (2013.01); *A43B 5/0405* (2013.01); *A43B 5/0407* (2013.01); *A43B 5/0417* (2013.01); *A43B 5/0441* (2013.01); *A43B 13/143* (2013.01); *A43B 13/148* (2013.01); *A43B 17/023* (2013.01)

(58) Field of Classification Search

CPC ..... A43B 7/145; A43B 7/26; A43B 13/143; A43B 13/148

USPC ..... 36/71, 94, 88, 113, 142–144

See application file for complete search history.

(56) References Cited

U.S. PATENT DOCUMENTS

| | | | | |
|---|---|---|---|---|
| 4,144,659 | A | | 3/1979 | Eisenberg |
| 4,494,324 | A | | 1/1985 | Spademan |
| 4,505,057 | A | | 3/1985 | Kiester |
| 4,533,154 | A | | 8/1985 | Bernard et al. |
| 4,573,678 | A | | 3/1986 | Lamb et al. |
| 4,589,216 | A | * | 5/1986 | Fuscone ..... 36/32 R |
| 4,765,070 | A | | 8/1988 | Chemello et al. |
| 5,005,301 | A | | 4/1991 | Mabboux |
| 5,075,984 | A | * | 12/1991 | Shiew ..... 36/113 |
| 5,140,758 | A | | 8/1992 | Damien |

(Continued)

FOREIGN PATENT DOCUMENTS

| | | |
|---|---|---|
| DE | 2752491 A1 | 3/1993 |
| DE | 3638887 A1 | 5/1997 |

(Continued)

OTHER PUBLICATIONS

Extended European Search Report for PCT/US2012/049486, Mar. 27, 2015, 7 pages.

*Primary Examiner* — Marie Bays

(57) ABSTRACT

This invention provides a novel elevated toe device system that allows the wearer's toes to be elevated to a perpendicular or approaching a perpendicular orientation relative to the line of gravity and undertake activities, such as downhill skiing, with a greater amount of control of the skis and/or snowboard as a result of the elevated toes. The conventional systems do not make use of the natural qualities of the foot. On a downward slope, the device permits the wearer to enjoy the dynamics of the foot and assume a stance that presents less strain on the foot while accentuating maneuverability. The device can be a preset system, in which the wearer can interchange devices of different angular orientations to modify the posture of the toes, or adjustable. In an alternate embodiment, the device can be provided so that the surface under the big toe presents an elevated angular orientation.

24 Claims, 15 Drawing Sheets

(56) References Cited

U.S. PATENT DOCUMENTS

| | | | | |
|---|---|---|---|---|
| 5,491,912 | A * | 2/1996 | Snabb et al. | 36/114 |
| 5,572,806 | A | 11/1996 | Osawa | |
| 5,625,966 | A | 5/1997 | Perotto et al. | |
| 5,692,318 | A * | 12/1997 | Aliano, Jr. | 36/25 R |
| 5,752,330 | A | 5/1998 | Snabb | |
| 5,877,687 | A | 3/1999 | Bernard et al. | |
| 6,131,315 | A * | 10/2000 | Frye et al. | 36/132 |
| 6,170,176 | B1 * | 1/2001 | Clough | 36/140 |
| 6,446,363 | B1 | 9/2002 | Artus | |
| 6,588,125 | B2 | 7/2003 | Proctor, Sr. | |
| 6,698,050 | B1 * | 3/2004 | Frye | 12/133 R |
| 6,938,363 | B1 * | 9/2005 | Clough | 36/140 |
| 7,040,042 | B2 | 5/2006 | Light | |
| 7,849,610 | B2 * | 12/2010 | Clough | 36/71 |
| 7,871,389 | B2 | 1/2011 | Plake et al. | |
| 8,523,194 | B2 * | 9/2013 | Smirman | 280/11.18 |
| 8,601,722 | B2 * | 12/2013 | Frye | 36/44 |
| 2002/0112378 | A1 * | 8/2002 | Kaneko | 36/127 |
| 2010/0287794 | A1 | 11/2010 | Jarvinen | |
| 2011/0187082 | A1 | 8/2011 | Morin | |

FOREIGN PATENT DOCUMENTS

| | | | |
|---|---|---|---|
| EP | 0389384 | A1 | 9/1990 |
| GB | 14532 | A | 0/1897 |
| JP | H0473001 | A | 3/1997 |

* cited by examiner

BOOT WITH MODIFIED ORIENTATION IN TOE REGION

RELATED APPLICATIONS

This application claims the benefit of U.S. Provisional Application Ser. No. 61/515,584, filed Aug. 5, 2011, entitled BOOT WITH MODIFIED ORIENTATION IN TOE REGION, the entire disclosure of which is herein incorporated by reference.

FIELD OF THE INVENTION

This invention relates to boots for use with winter sports and mountaineering, and more particularly to structures provided at the toe region of such boots.

BACKGROUND OF THE INVENTION

For many thousands of years, people have been going up and down mountains. Since people began wearing shoes for this activity, the footwear has evolved. In skiing, footwear has changed from skin boots filled with fur, felt or grass to modern cast polymer shells enclosing a padded liner. The sole of the boot can be rigid along its length or more flexible for different types of skiing. In mountaineering, old hobnail leather boots have given way to modern leather or polymer constructions with a treaded sole of rubber compounds or polymers.

The foot is a complex mechanical appendage. The human foot consists of 26 bones and is arranged into several regions. The heel region consists of the heel and ankle bones. The midfoot has five irregular bones and describes an arch, that in combination with ligaments and muscles serves as a shock absorber. The forefoot consists of the long metatarsal bones and the toes. The region of the bottom of the foot where the toes meet the metatarsal bones is a padded feature referred to as the ball of the foot.

Unlike the padded paws of dogs or the hoofed feet of horses, the human foot is remarkably versatile and is equally good as a platform upon which a person can steady themselves to lift great weights, or limber enough for someone to scale a great coconut tree to retrieve fruits from the treetop. The human foot can be controlled to become a rigid pivot for a ballerina or as a flat sensitive surface for a high speed race car driver, through which vibrations and feedback can be detected.

The toes are essential for human locomotion such as walking, running and jumping. The toes are where the forward motion of a human being is energized by transferring energy from the toes to the ground. The human toe has a normal range of motion between eighty degrees above the horizontal prone position and a downward range of twenty degrees. Runners dig in their toes with an upward bend of up to eighty degrees then explode from the line and accelerate by using the toes to apply downward pressure on the ground. This downward pressure is maximized as the toes approach eighty degrees of flexure and is released as the toes return to the prone position. The toes are sufficiently strong enough to withstand the forces involved. Sprinters rely on the flexure of the front of the foot for control, comfort, speed and acceleration. Boxers tend to balance on their toes for optimal maneuvering. The overall flexibility, design and strength of the human foot are performance enhancing assets and essential for control.

In downhill skiing, snowboarding and mountaineering, the boot sole is inflexible, reducing the inherent performance of the foot by restricting toe flexibility. The only toe flexibility possibility is from curling the toes downward to twenty degrees below the prone position. These boots do not permit upwards flexure to eighty degrees and therefore prevent a maximization and optimization of downward toe pressure.

By way of further background, FIG. 1 is a partial cross-sectional view of a conventional ski boot 100, in which the lower shell of the boot 102 has been cut away to expose the inner liner 104 and a representative foot 106. The toe region 108, ball of the foot region 110 and the heel 112 (not shown) are coplanar and parallel to the line of the horizontal plane HP1 relative to the ski (not shown), whether going downhill or on the level. This is not an optimal use of the foot because the toes are not able to be flexed upwards toward eighty degrees relative to the center of gravity.

FIG. 2 is a side view of a representative foot 200, showing the range of possible flexure of the toes 202, from the center of the ball of the foot region 204. The toes can be flexed upwards from the horizontal plane HP2 through an arc of motion 206 to a maximum angular toe orientation 208 relative to the horizontal plane HP2 that describes an elevated angle of eighty degrees (80°). In a similar fashion, the angular toe orientation 210 describes an elevated angle of sixty-five degrees (65°). The angular toe orientation 212 describes an elevated angle of forty-five degrees (45°). The angular toe orientation 214 describes an elevated angle of thirty degrees (30°). The angular toe orientation 216 describes an elevated angle of fifteen degrees (15°). The angular toe orientation 218 describes an elevated angle of ten degrees (10°). The angular toe orientation 220 describes a declining angle of fifteen degrees (15°) below the horizontal plane HP2. These elevations and declinations are representative of the multiple orientations of the toes in their normal full range of motion. This vast range of possible toe positions is essential for human movement, whether as a sprinter, rock climber or a dancer. But conventional ski boots prevent the toes from flexing to the optimal position for applying downward pressure by locking the toes in the prone position.

It is desirable, therefore, to provide a structure that is either removable, adjustable or integral to the boot system, which allows for reorientation of the toes so that they are better positioned to carry out the tasks of either skiing, snowboarding or mountaineering going downhill on inclined terrain. This structure and the associated functionality it provides will make possible the increased use of the toes in skiing and/or mountaineering for greater control, comfort and safety.

SUMMARY OF THE INVENTION

This invention overcomes the disadvantages of the prior art by providing a novel elevated toe device or inclined base system mounted in the toe box region of the boot that allows the wearer's toes to be elevated to a perpendicular or approaching a perpendicular orientation relative to the line of gravity while undertaking activities, such as downhill skiing, with a greater amount of control of the skis and/or snowboard as a result of the elevated toes. The wearer is defined as the person wearing the boot(s). Unlike the conventional systems, that maintain the toes in a flattened prone position and does not make use of the natural qualities of the foot, on a downward slope. The elevated toe device or base of the illustrative embodiments herein permits the wearer to enjoy the dynamics of the foot and assume a stance that presents less strain on the foot while accentuating maneuverability in line over the center of gravity. The elevated toe device can be a preset system, in which the wearer can interchange elevated toe devices of different angular orientations to modify the posture of the toes, or adjustable. In an alternate embodiment, the elevated toe device can be provided so that the surface under the big toe presents an elevated angular orientation.

In an illustrative embodiment the system and method generally defines a boot with a modified toe region used by a wearer to traverse a declined surface. In general, the result of the use of the elevated toe device is that the wearer can apply greater downward pressure on the skis, thereby controlling the skis much better than with a conventional boot. The boot is equipped with a base that is located in the toe region. The base is constructed and arranged to bias the toes of the wearer into an upwardly elevated orientation that is adapted to conform to a slope of the inclined surface so as to provide improved control while traversing that inclined surface. The base can be part of an elevated toe device located in the toe region, and the elevated toe device can be formed as part of an inner liner or can be a plate that is built integrally with the sole of the boot. The base can define an adjustable plate that moves between a plurality of inclined angular orientations so as to variably position the toes at a plurality of angles with respect to a midfoot region. The base can be a wedge-shaped insert that is placed within the inner boot liner, built into the liner or placed under the liner. Removable inserts can be furnished as part of a kit that includes a plurality of inserts, each with a different angular orientation, The toe region of the boot can illustratively include a space along a topside thereof that is constructed and arranged to provide clearance for the toes in the upwardly elevated orientation In another embodiment, the elevated toe device can be a plate that is connected to an adjustment mechanism that allows the toe angular orientation to be conveniently modified without having to interchange elevated toe devices. The elevated toe device can be adjusted by an air bladder that raises and lowers within the boot by pneumatic inflation and deflation. The elevated toe device can have a plate that includes a click mechanism and a plurality of inter-engaging slots that allow adjustment of the toe device. The elevated toe device can be constructed and arranged to provide a preset angular orientation relative to the elevation of the toes. The elevated toe device can be constructed and arranged to define a shape that positions a big toe of the wearer so that it has a different angular orientation than the rest one of the other toes on the same foot. The adjustable plate can move between a plurality of elevations so as to variably position the toes at a plurality of degrees of elevation with respect to the prevailing angle of the ski trail and is adjusted by a transverse mounted screw mechanism that is rotated by a wrench interacting with a conforming receiving structure on the screw. The toe plate can be raised and lowered with the boot by a motor (e.g. an electric motor) that is operated by, for example, control buttons located on the exterior of the boot or by remote control.

The adjustment of the elevated toe device can include preset or variable settings. Indicia can be provided that are gradated in numbers, letters or symbols. It is contemplated that with the rise in popularity of this system that ski areas will assign suggested relevant elevated toe device settings for each recreational slope to maximize the experience.

Additionally, the elevated toe device can be employed in Telemark-style ski boots, snow board boots and mountaineer boots for the same purpose of elevating the toes. The elevated toe device can also be employed in these activities as part of physical therapy.

BRIEF DESCRIPTION OF THE DRAWINGS

The invention description below refers to the accompanying drawings, of which.

DETAILED DESCRIPTION

Figure 1:
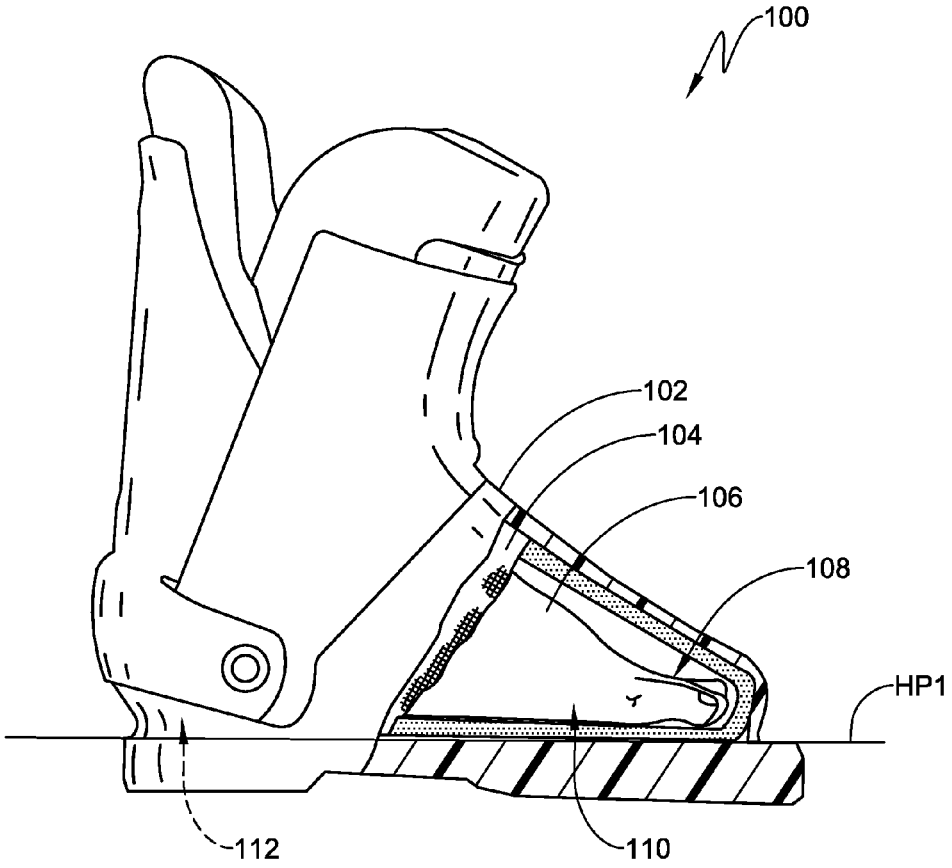
Fig. 1 (Prior Art)
FIG. 1, already described, is a partial cross-sectional view of a conventional ski boot in which the toes and midfoot regions of the foot are trapping and held flat inside the boot according to the prior art.
Figure 2:
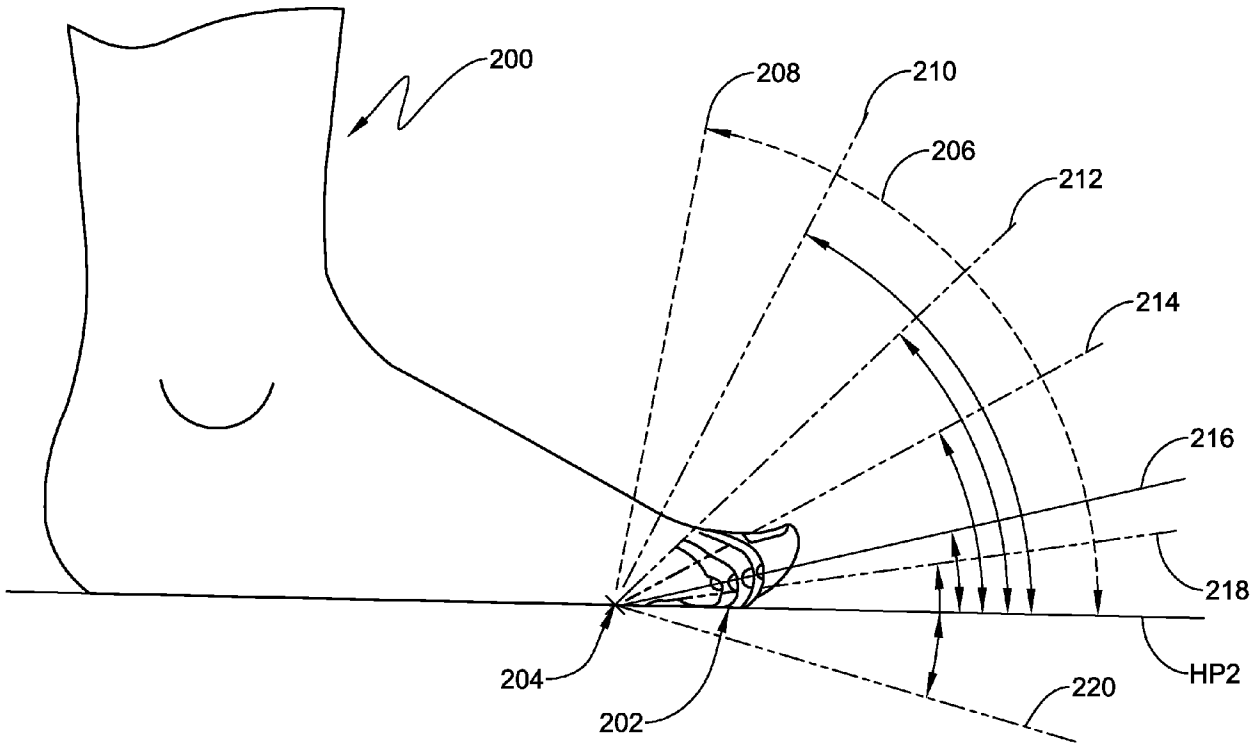
Fig. 2 (Prior Art)
FIG. 2, already described, is a side view of a representative foot showing the range of possible motion of the toes and angular orientations according to the prior art.
Figure 3:
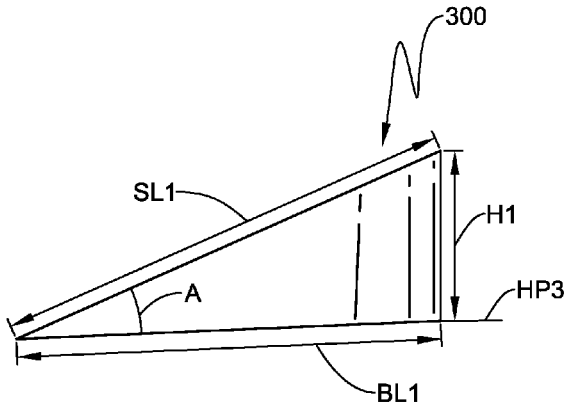
FIG. 3 is a frontal view of the illustrative elevated toes device, detailing various dimensions according to an illustrative embodiment.

FIG. 3 shows an illustrative elevated toe device 300 for modifying the toe orientation within a ski boot according to an illustrative embodiment. The illustrative elevated toe device is depicted having an angular orientation A of approximately twenty-two and a half degrees (22.5°) of elevation relative to the horizontal plane HP3. In alternate embodiments, the elevated toe device can be furnished with a steeper degree of elevation or less elevation. The elevated toe device 300 is shown with a bottom length BL1 of approximately 70 mm, a height H1 of approximately 30 mm and a slope length SL1 of approximately 80 mm. These dimensions are illustrative only and will vary depending on the particular angular orientation and relative to the size of a wearer's toe region. Human toes vary greatly in length, and longer toes will need a proportionally larger elevated toe device than shorter toes, and vice-versa. The elevated toe device can be fashioned from shaped wood products, polymers or any other material that provides a rigid surface. The elevated toe devices can be insulated to reduce cold conductivity. The elevated toe device 300 is placed within a ski boot liner, under a ski boot liner, within a ski boot liner or molded into the boot shell, as will be described more fully below. The weight of the elevated toe device 300 depends on the material(s) of which it is constructed and will weigh between approximately 2 to 16 ounces. It is expressly contemplated that a plurality of interchangeable elevated toe devices of various preset angular orientations can be provided as part of a kit, to provide for variations in the elevation of the toes. It is also contemplated that an elevated toe device can be provided with an internal adjustment mechanism that can provide for removable of a device, adjustment of the angular orientation and re-installation for use.

Figure 4:
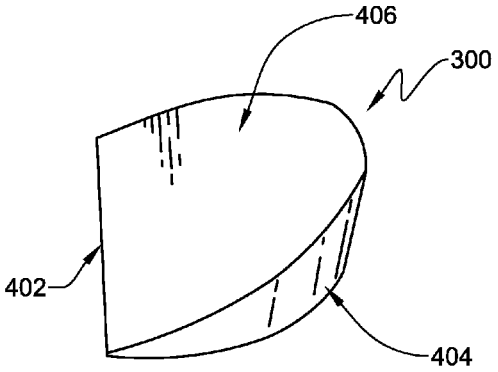
FIG. 4 is an elevated perspective view of the elevated toe device of FIG. 3 according to an illustrative embodiment.

FIG. 4 shows the elevated toe device 300 of FIG. 3. The elevated toe device 300 is furnished with a straight back edge 402 and a curved front edge 404. The curvature of the front edge 404 is shaped relative to the curvature of the inside of a ski boot. The sloped upper surface 406 of the elevated toe device 300 is depicted as a flat surface. In alternate embodiments, it can be contoured to the underside of the wearer's toes. The upper surface 406 can also be provided with a layer of an elastomeric polymer (according to either a novel or conventional formulation) in order to cushion the bottom of the foot. It is expressly contemplated that the elevated toe device can be fabricated from polymers, foams, recycled materials or other materials that create a similar structure.

Figure 5:
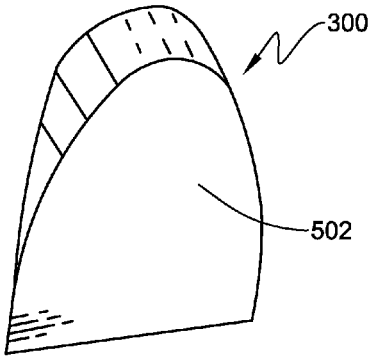
FIG. 5 is a perspective view of the bottom of the elevated toe device of FIG. 3 according to an illustrative embodiment.

FIG. 5 shows of the elevated toe device 300 of FIG. 3, showing the bottom surface 502. The bottom surface 502 is depicted herein as flat, but in an alternate embodiment it can be concave or hollow.

Figure 6:
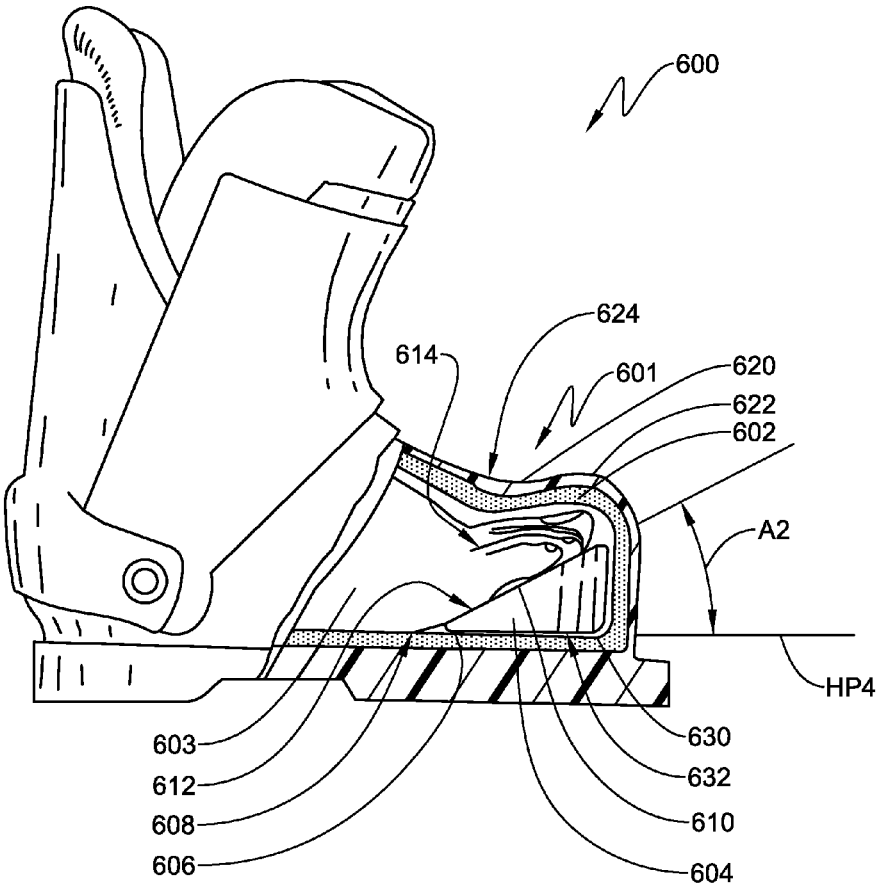
FIG. 6 is a partial cross-sectional view of an illustrative ski boot that depicts the elevated toe device placed within the boot liner according to an illustrative embodiment.

FIG. 6 is a partial cross-sectional view of an exemplary ski boot 600, in which the lower shell of the boot system 601 has been cut away to expose the inner liner 602 and a representative foot 603. The elevated toe device 604 is provided according to the elevated toe device 300 described above. Elevated toe device 604 is seated inside the liner 602 according to this embodiment. Alternatively, as set forth below, the elevated toe device can be placed inside or below the liner. The back edge 606 is arranged such that it makes contact with the region of the ball of the foot 608. The upper surface 610 of the elevated toe device slopes to make contact with the underside surface 612 of the toes 614. The angular orientation A2 of the elevated toe device 604 is depicted herein as approximately thirty degrees (30°) above the horizontal plane HP4.

The top surface 620 of the boot 600 is raised over the boot toe 622 and concave in the midfoot region 624 behind the toe. This raised portion is to accommodate the presence of the elevated toe device 602 and the elevation of the toes that results therefrom. The raised aspect of the toe will be described more fully below.

Figure 7:
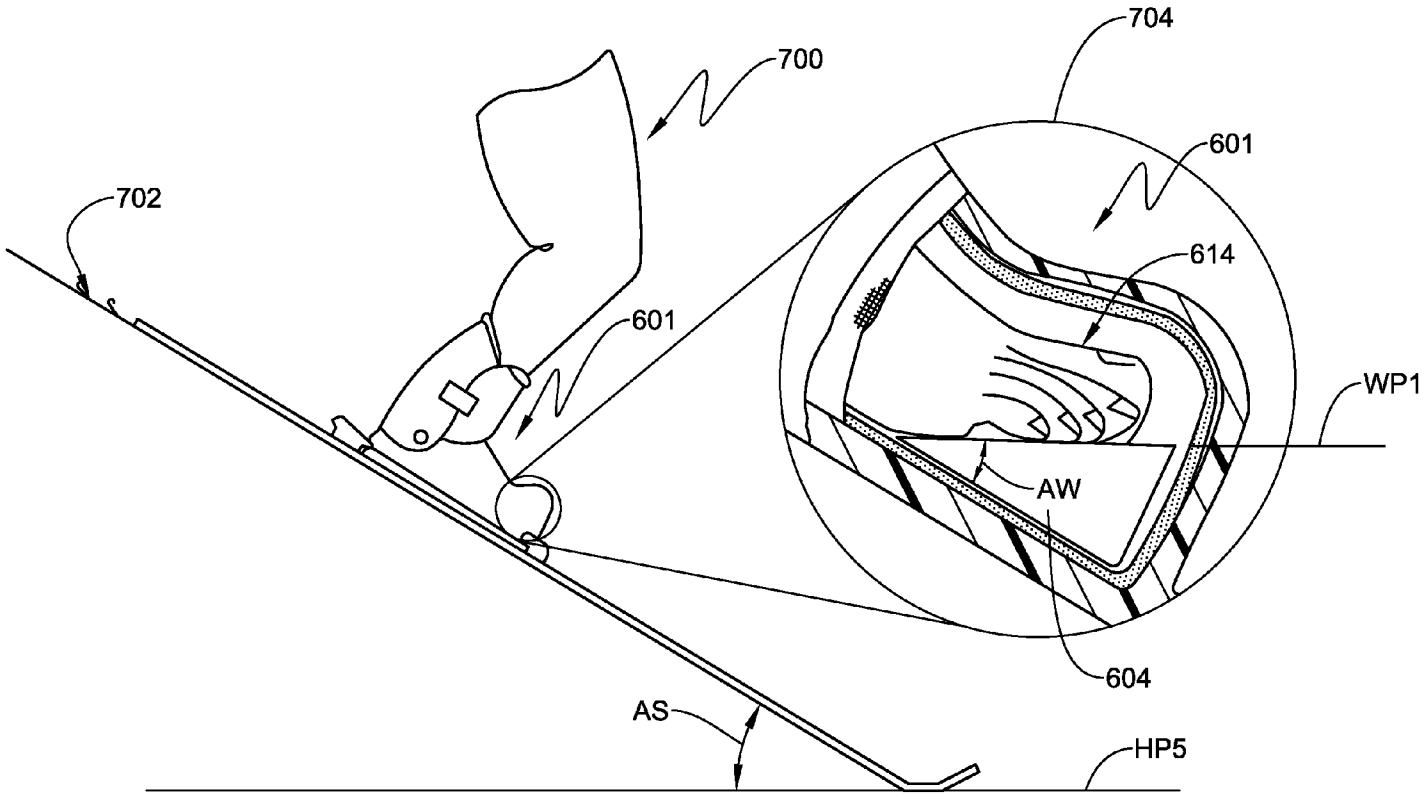
FIG. 7 is a view of the ski boot and elevated toe device of FIG. 6 as presented on a downward slope according to an illustrative embodiment.

FIG. 7 shows the boot system 601 of FIG. 6 above, in which a skier 700 is going downhill on a slope 702. The enlarged inset 704 depicts the toe region of the boot system 601 in greater detail. The angle of the slope AS is variable. The angular orientation AW of the elevated toe device 604 elevates the toe region 614 such that it is not parallel to the plane of the slope 702 and is approaching an orientation that is almost parallel to the horizontal plane HP5. This orientation is approaching a point where the toes are elevated to 90 degrees, that is perpendicular to the line of gravity. By placing the toes in this elevated orientation, the toe device allows the wearer to exert a greater downward pressure through the toes to the skis than is possible in conventional ski boots, with the resulting greater speed and control.

Because the prevailing angle of the slope AS is variable, the plane of the elevated toe device WP1 is variable. The relative orientation of the toes 614 to the slope can be described as the difference between the slope angle AS and the angle of the elevated toe device AW, and is expressed by the equation AS-AW. When this difference is low, the control and comfort are improved. As the difference increases, the benefits remain, but the results will diminish as a slope approaches vertical and the elevated toe device approaches a very low angle. The optimal degree of toe elevation is the exact elevation of the ski course slope.

Where a ski course slope is steep (for example, over forty-five degrees), an elevated toe device having a greater orientation angle approaching the angle of the ski slope can provide a different experience from a conventional boot, with more control and comfort. Unlike conventional ski boots, that lock the foot in to a flat orientation and prevent any toe elevation, the elevated toe device 604 provides both the fine and greater control that the elevated toes provide and the improved comfort to the foot.

The elevated toe device 604 as depicted in FIGS. 6 and 7 above is shown as an exchangeable insert into a boot liner 602. In this embodiment, it is contemplated that the wearer can place the insert inside the surface of the bottom 630 of the liner. The insert is a removable elevated toe device. The bottom surface 632 of the elevated toe device can be secured by various securements, including a hook and loop system, snap locks or an adhesive. This provides an interchangeability of elevated toe devices having different angular orientations, so that the elevation of the toes can be adjusted to conform to the prevailing slope of the trail. For example, if a skier desires to change inserts from a lower angular orientation to a higher angular orientation to ensure a more controlled skiing experience on the same slope. Alternatively, the insert 604 can be provided at an average elevation and permanently affixed to the inside of the liner.

Figure 8:
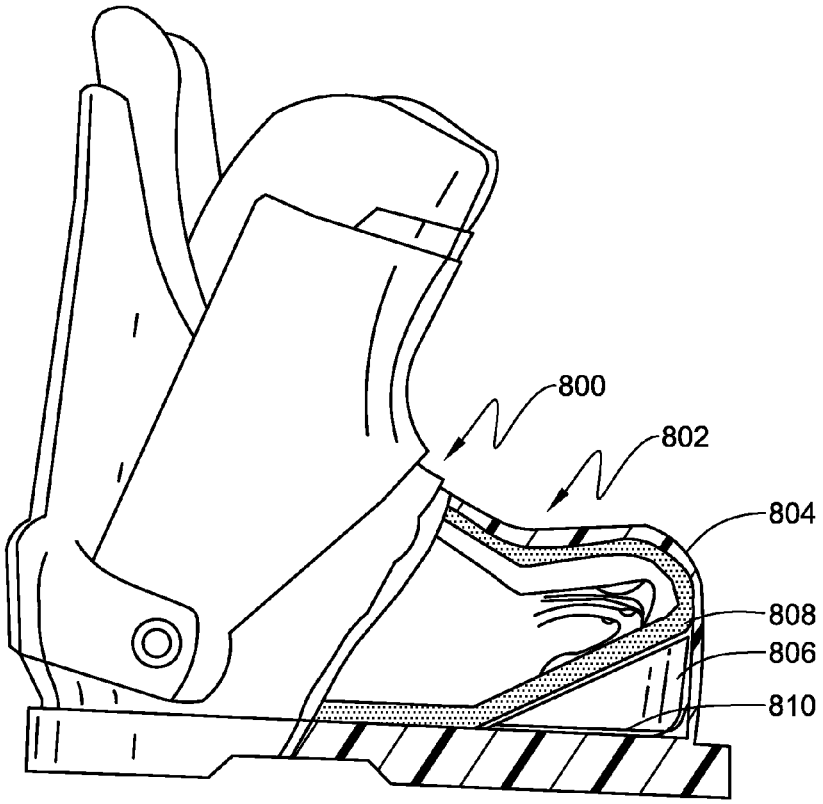
FIG. 8 is a partial cross-sectional view of an illustrative ski boot that depicts the elevated toe device placed beneath the boot liner according to an illustrative embodiment.

In an alternate embodiment, FIG. 8 is a partial cross-sectional view of an exemplary ski boot 800, in which the toe region 802 has been cut away to expose the inner liner 804 and an elevated toe device 806 that is positioned below the liner, such that the elevated toe device is sited between the bottom 808 of the liner 804 and the inner surface 810 of the toe region 802 of the boot. The elevated toe device can be permanently mounted or removable.

Figure 9:
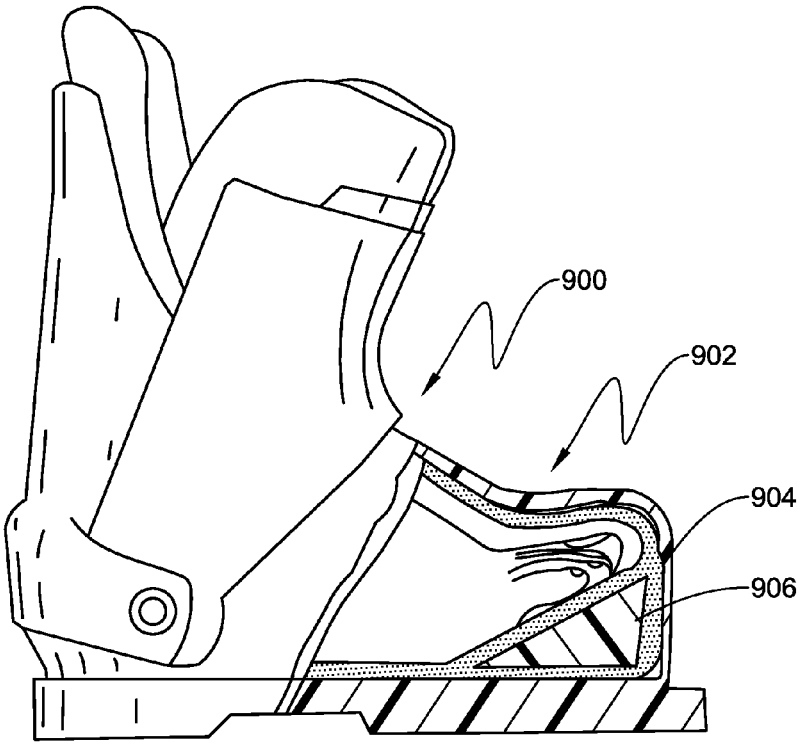
FIG. 9 is a partial cross-sectional view of an illustrative ski boot that depicts the elevated toe device built into the boot liner according to an illustrative embodiment.

In another alternate embodiment, FIG. 9 shows a partial cross-sectional view of an exemplary ski boot 900, in which the toe region 902 has been cut away to expose the inner liner 904 and an elevated toe device 906 that has been incorporated into the toe of the boot liner's structure. In this embodiment, an elevated toe device having a fixed elevation has been inserted into the toe of the liner during the manufacturing process. It is expressly contemplated that the elevated toe device can be molded into the boot shell at a preset angular elevation that causes the toes in the boot liner to be elevated.

Figure 10:
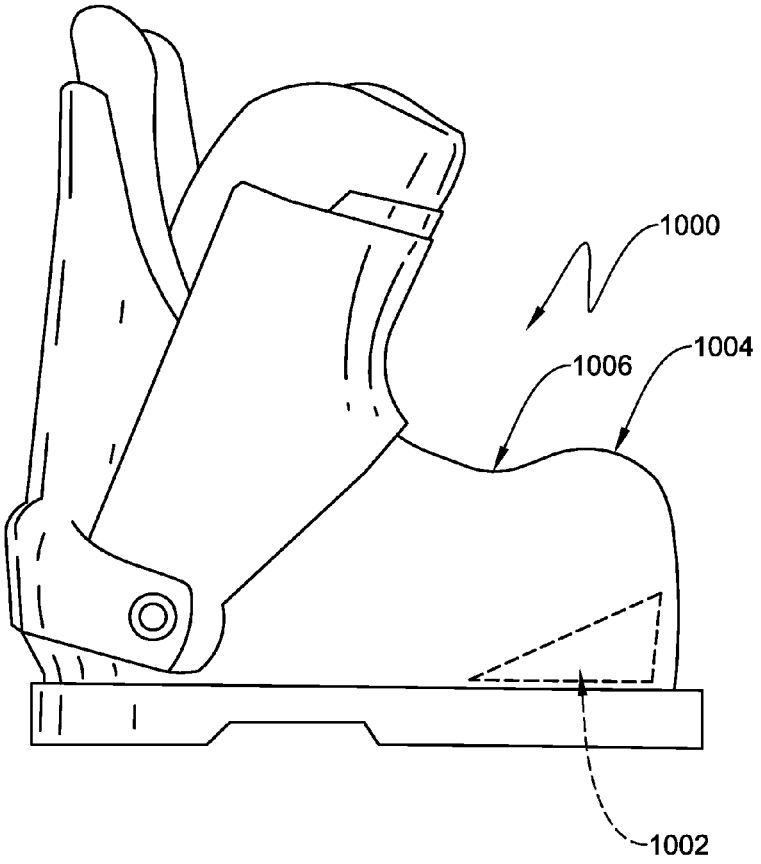
FIG. 10 is a side view of an illustrative ski boot containing an elevated toe device and having a bulbous raised toe region according to an illustrative embodiment.

While the introduction of an elevated toe device into the toe of a conventional ski boot is possible where the elevated toe device has a minimal angular orientation of about one degree of elevation, a revised boot geometry will be desirable to accommodate the raised toes. FIG. 10 is a side view of a boot 1000 with an elevated toe device system 1002 (shown in broken lines), according to an illustrative embodiment. The toe box portion 1004 is raised and the topside of the midfoot region 1006 is concave. The raised toe box is necessary to provide space for the raised toe region of the wearer's foot. The raised toe box also provides for the necessary toe pressure in the elevated configuration that enhances both control and the enjoyment of the activity. It is expressly contemplated that the toe region 1004 of the boot can be fashioned of a different colored material, a different material or includes lighting effects that identify the boot as containing an elevated toe device and thereby serve to promote awareness of the system.

Figure 11:
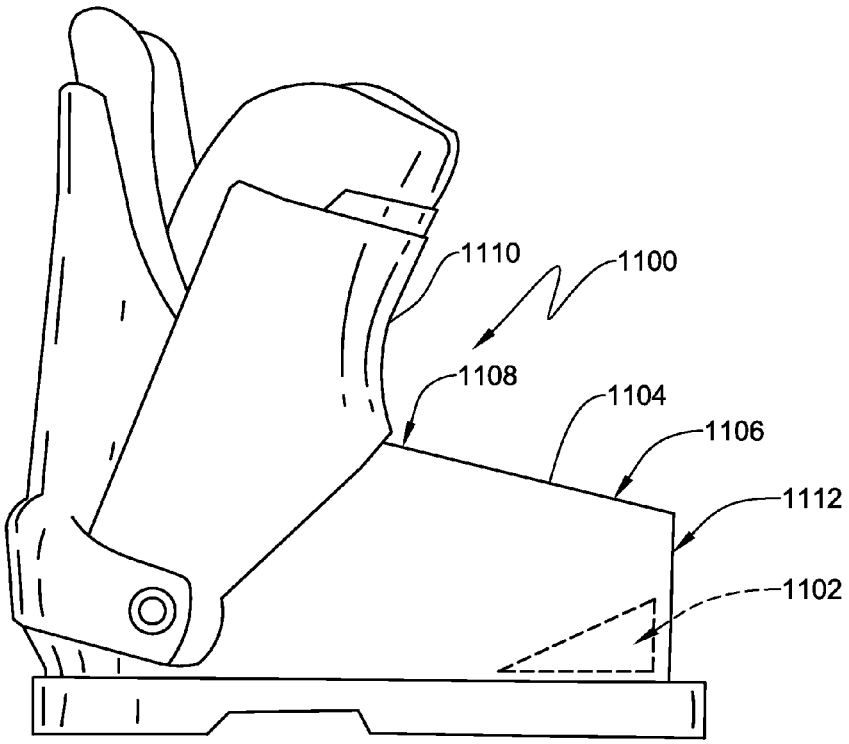
FIG. 11 is a side view of an illustrative ski boot containing an elevated toe device and having a sloped raised toe region according to an illustrative embodiment.

FIG. 11 shows a boot 1100 with an elevated toe device 1102 (shown in broken lines), according to an illustrative embodiment. The top surface 1004 of the toe portion 1106 is uniformly tapered from the junction 1108 of the toe portion 1106 and the upper portion 1110, to the front 1112 of the boot. This raised portion serves the same purpose as set forth in FIG. 10 above, but avoids a concavity and provides for more-straightforward and/or cost-effective manufacturing techniques.

Figure 12:
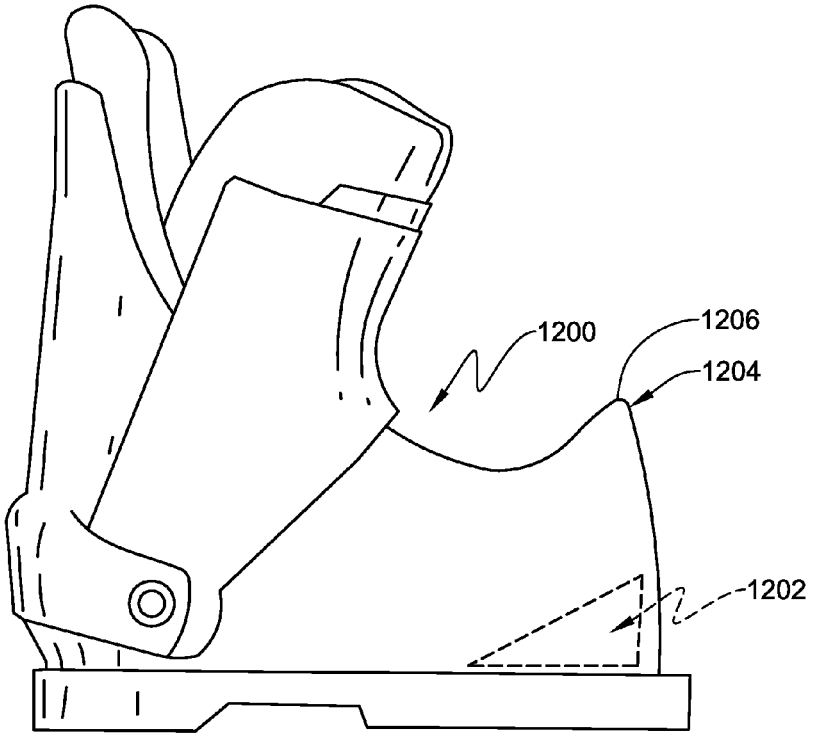
FIG. 12 is a side view of an illustrative ski boot containing an elevated toe device and having a pointed raised toe region according to an illustrative embodiment.

FIG. 12 shows a boot 1200 with an elevated toe device 1202 (shown in broken lines), according to another illustrative embodiment. This embodiment depicts a boot in which the toe region 1204 is raised to accommodate the presence of the elevated toe device and rises to a point 1206 so that the shape of the boot is unusual and more identifiable as containing an elevated toe device. The raised point 1206 creates an additional space in the boot that can function as an air pocket to trap warmth, house a camera, a ventilation system or other devices. It is expressly contemplated that the raised toe can be decorated, of a different color than the remaining boot or be fitted to include lighting effects.

Figure 13:
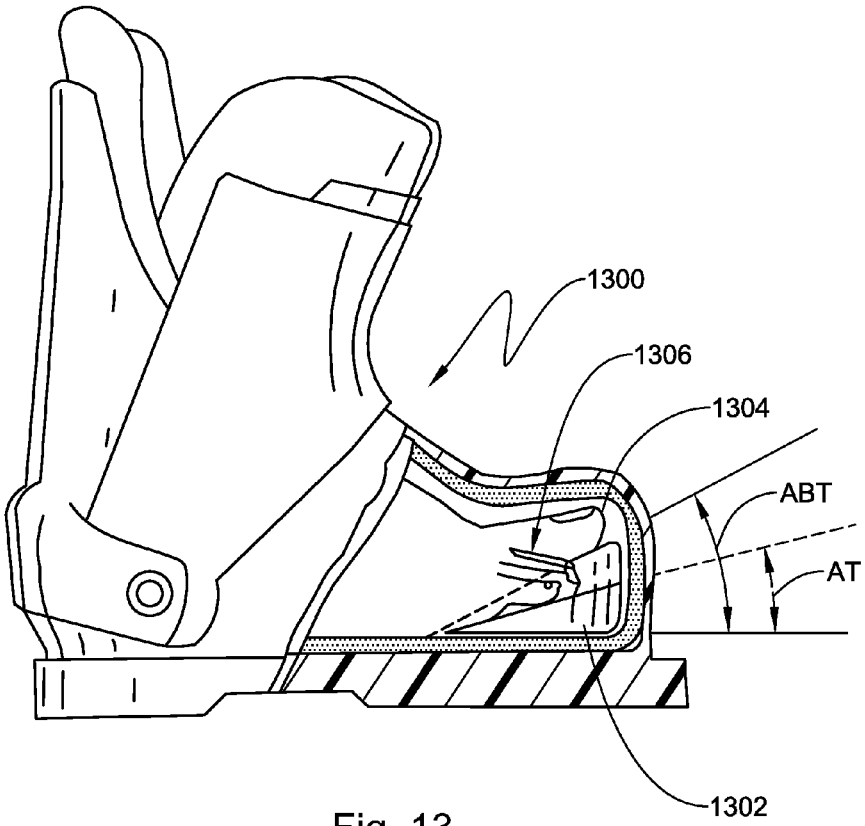
FIG. 13 is a partial cross-sectional view of an illustrative ski boot that depicts an elevated toe device in which one toe is elevated at a different angular orientation from the rest according to an illustrative embodiment.

The shape of the elevated toe device can be modified such that the big toe of the wearer's foot has a different angular alignment from the other toes on the same foot. FIG. 13 is a side view of a boot 1300 with an elevated toe device 1302, according to an alternate embodiment. In this embodiment, the big toe 1304 is raised relative to the rest of the toes 1306 and in a different angular orientation. In this example, the angular orientation of the big toe ABT is greater than the angular orientation of the remaining toes AT.

Figure 14:
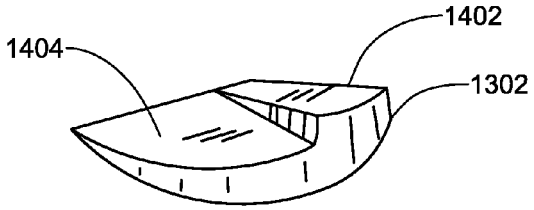
FIG. 14 is an elevated perspective view of the elevated toe device of FIG. 13 according to an illustrative embodiment.

FIG. 14 shows the elevated toe device 1302 described in FIG. 13 above and describes a relatively higher elevation 1402 for the big toe that is more than the rest of the toes 1404.

The foregoing has described a toe elevated toe device for a boot in which the elevated toe device is either fixed or removable for the purpose of changing the orientation of the toe angles. FIGS. 15 to 21 below describe embodiments in which the wearer can adjust the toe elevation comfortably on the slopes using various systems and devices. This allows a wearer to adapt the toe angles to meet different skiing challenges and slope angles.

Figure 15:
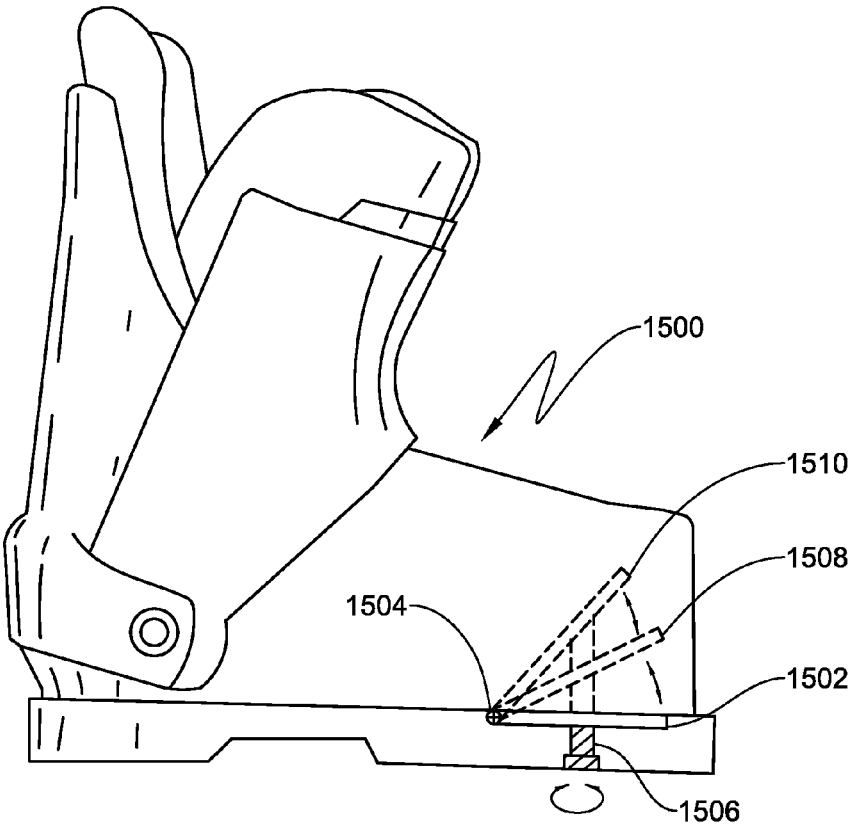
FIG. 15 is a side view of an illustrative ski boot containing an elevated toe device plate that is adjustable by operation of a screw mechanism that is set into the bottom of the boot according to an illustrative embodiment.

FIG. 15 shows a boot 1500 with a movable pivoting toe plate 1502, according to an illustrative embodiment. The toe plate 1502 functions as the elevated toe devices as set forth above and is secured at a pivot point 1504 where it is either connected to the rest of the boot by a flap, hinge or similar feature. A screw mechanism 1506 rotates to raise the toe plate 1502 to elevated positions 1508, 1510 that present greater angular orientations. As noted above, on a steeper slope, a higher angular orientation might be desired. To do so, the wearer adjusts the elevation by rotating the screw mechanism 1506, causing the toe plate to rise or lower. It is desirable that the screw mechanism hold the toe plate securely in the designated elevation.

Figure 16:
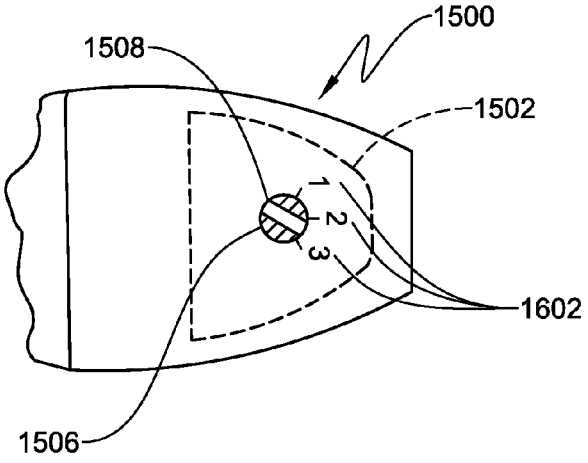
FIG. 16 is an bottom view of the toe region of the boot of FIG. 15, depicting the operative head of the screw mechanism according to an illustrative embodiment.

FIG. 16 shows the front of the boot 1500 of FIG. 15 and the screw mechanism 1506 for the toe plate 1502 (shown in broken lines). The elevation setting indicia markings 1602 are depicted as numbers, but it is expressly contemplated that multiple settings can be depicted and that the numbers can be substituted with symbols depicting trail ratings (e.g., black diamonds, blue squares and the like). It is further contemplated that popularity of this system can inspire ski areas to provide recommended toe plate settings for a ski trail in the form of "dial settings". Slot 1508 can accommodate various rotation systems, for example, a screw driver head, ski pole or suitable coin.

Figure 17:
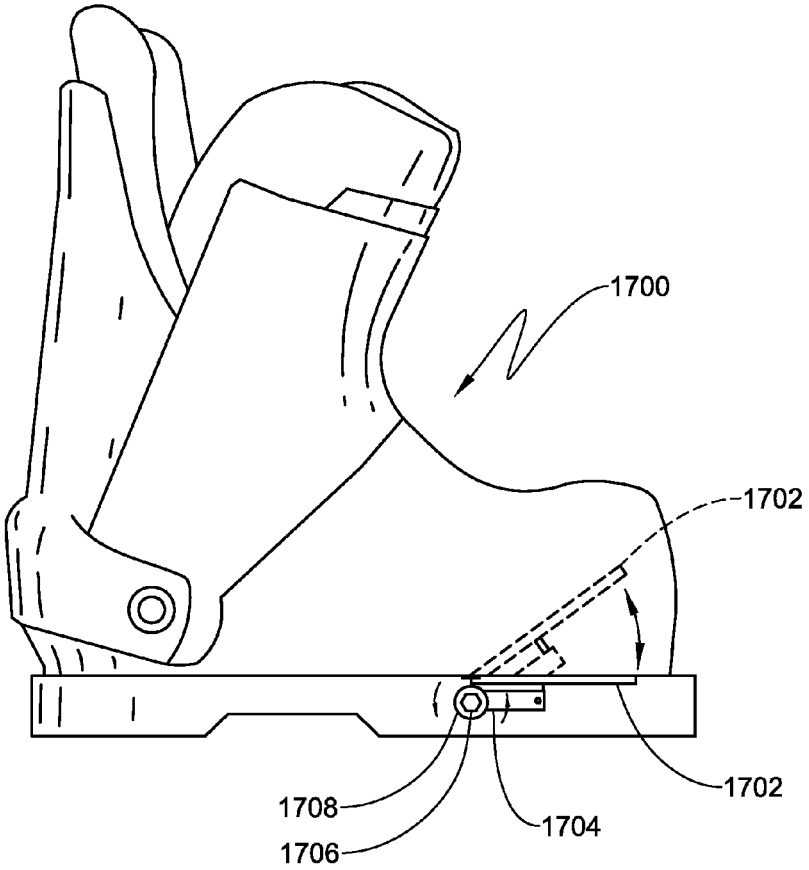
FIG. 17 is a side view of an illustrative ski boot containing an elevated toe device plate that is adjustable by operation of a screw mechanism that is transverse and set into the side of the boot according to an illustrative embodiment.

FIG. 17 depicts a boot 1700 with a pivoting toe plate 1702, according to an illustrative embodiment. The toe plate 1702 functions as the toe plate 1502 above, but is actuated by a transverse mounted screw mechanism 1704 that is rotated by means of an wrench (not shown) and features a conforming wrench socket 1706 (or another tool for rotating a threaded member). It is contemplated that any wrench system that has a conforming receiving structure can be used. The side of the boot 1708 can include elevation setting indicia markings of the type described above.

Figure 18:
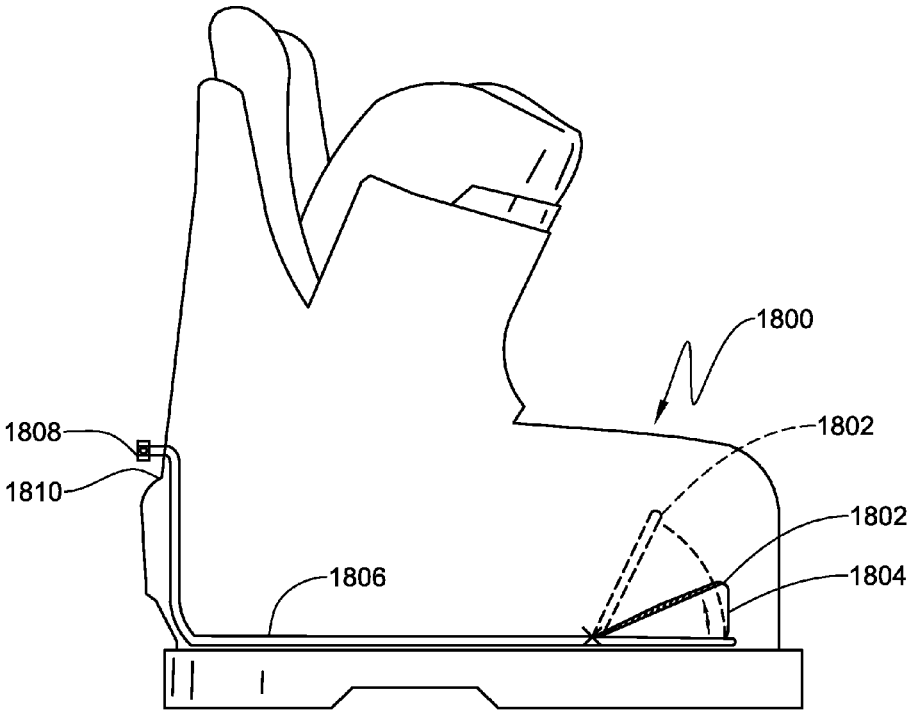
FIG. 18 is a side view of an illustrative ski boot containing an elevated toe device plate that is adjustable by operation of a pneumatic bladder according to an illustrative embodiment.

FIG. 18 is a side view of a boot 1800 with a pivoting toe plate 1802, according to an illustrative embodiment. In this embodiment, the angular orientation of the toe plate 1802 is adjusted by an air bladder 1804 that resides under the toe plate. The elevation is modified by increasing or decreasing the air pressure. An air hose 1806 is placed under the liner (not shown) and connects to a nozzle 1808 sited above the heel 1810 of the boot. It is contemplated that wearers can carry a portable air pump (not shown) in their pocket to engage with the nozzle 1808 to increase the air pressure and the relative toe angle, or to release the nozzle and reduce the pressure in the bladder 1804 to decrease the toe angle. It is expressly contemplated that other gases can be substituted for air in different applications, such as helium, nitrogen, oxygen or carbon dioxide, and that the air pump can contain a disposable or re-fillable pre-charged canister of the filling gas.

Figure 19:
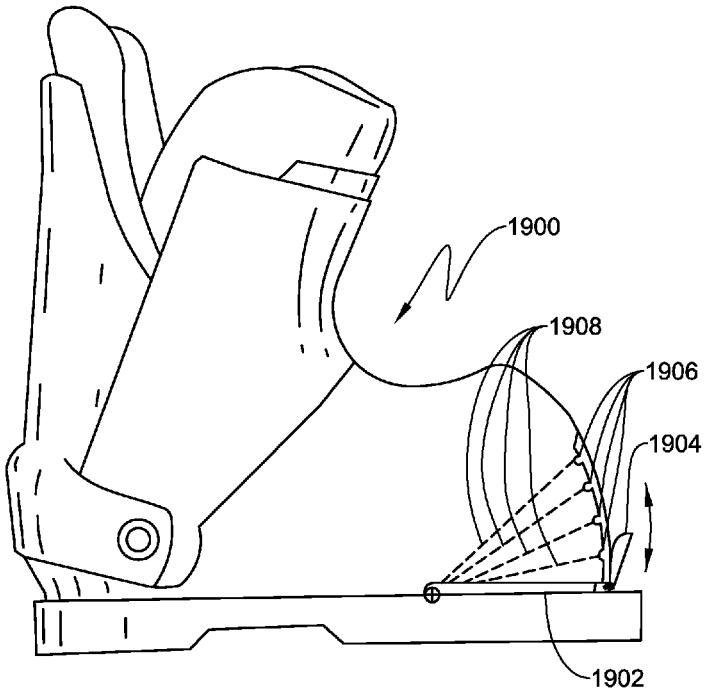
FIG. 19 is a side view of an illustrative ski boot containing an elevated toe device plate that is adjustable by operation of a click and slot system that is built into the front of the boot according to an illustrative embodiment.

FIG. 19 is a side view of a boot 1900 with a pivoting toe plate 1902, according to the illustrative embodiment. The angular orientation of toe device plate 1902 is adjusted by action of a click mechanism 1904 and a plurality of inter-engaging slots 1906. In this embodiment, four elevated positions 1908 for toe plate are depicted, each with a corresponding slot 1906. It is expressly contemplated that there can be more or less positions 1908, with a corresponding number of slots 1906. It is further contemplated that each slot can feature indicia that express a number, letter or symbol that relates to that setting. The wearer is able to manually disengage the click mechanism 1904, raise or lower it to respectively increase or decrease the elevation.

Figure 20:
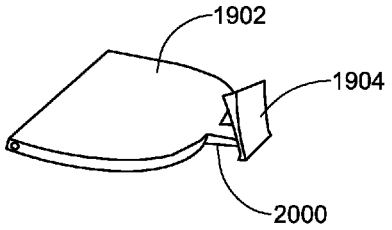
FIG. 20 is an elevated perspective view of the toe plate of FIG. 19 according to an illustrative embodiment.

FIG. 20 shows the toe plate 1902 of FIG. 19 and depicts the related click mechanism 1904 and a connecting stem 2000.

Figure 21:
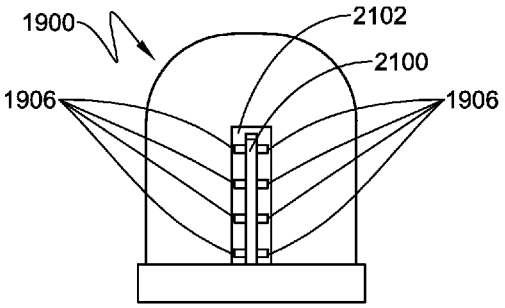
FIG. 21 is a front view of the toe of the boot of FIG. 19 according to an illustrative embodiment.

FIG. 21 shows the front of the boot 1900 of FIG. 19 and depicts the positional slots 1906, the pass through slot 2100 that allows the connecting stem 2000 to join the exterior mounted click mechanism with the toe plate (not shown). The slots 1906 reside within a recess 2102 that is wide enough to accommodate the click mechanism and prevents it from protruding too far from the profile of the boot, that might result in its damage or loss.

It should be clear that the elevated toe device or base structure according to the various embodiments herein provides a substantial improvement over conventional boot arrangements. The adjustability of the system in various embodiments allows the wearer to customize his or her boot to the prevailing slope of a ski trail. This ensures a better skiing, riding or similar experience.

The foregoing has been a detailed description of illustrative embodiments of the invention. Various modifications and additions can be made without departing from the spirit and scope of this invention. Each of the various embodiments described above can be combined with other described embodiments in order to provide multiple features. Furthermore, while the foregoing describes a number of separate embodiments of the apparatus and method of the present invention, what has been described herein is merely illustrative of the application of the principles of the present invention. For example, the top of the toe region of the boot can be removable to access the elevated toe device, that can be secured to the inside sole of the boot by threaded bolts. The elevated toe device can be emplaced into the toe of a telemark-style ski boot, mountaineer boot or snow board boot, according the system and methods set forth above. The elevated toe device can be used in these sports as part of rehabilitative physical therapy. The elevated toe device and/or the region of the boot around the elevated toe device can be provided with an electric or chemical heat generator. The elevated toe device adjustment can be actuated by means of an electrically-driven mechanism and controlled either by an external activator button or remote control. In addition, where the elevated toe device is a removable structure, a kit of elevated toe devices having an assortment of angles can be provided. The appropriate elevated toe device is selected and installed by the wearer based upon conformance to a particular incline of a slope to-be-traversed by the wearer. Accordingly, this description is meant to be taken only by way of example, and not to otherwise limit the scope of this invention.

What is claimed is:

1. A system of modifying a toe box region of a boot used by a wearer to traverse an inclined surface, comprising:

a base that is located in the toe box region;

wherein the toe box region includes a means for adjusting toes of the wearer to a selected one of a plurality of elevated orientations so as to thereby provide improved control while traversing the inclined surface, wherein each of the plurality of elevated orientations being at a different angle and wherein the elevated orientation being selected is such as to conform to a prevailing angle of the slope of the inclined surface being traversed; and wherein the means for adjusting the toes is such that said means extends less than half the length of the boot.

2. The system as set forth in claim 1, wherein the means for adjusting comprises an elevated toe device.

3. The system as set forth in claim 2, wherein the elevated toe device is arranged so that the elevated toe device is disposed between an inner surface of the toe box region in the boot and an outside surface of an inner liner of the boot.

4. The system as set forth in claim 1, wherein the boot includes a liner having a cavity therein for removably receiving a foot of the wearer and wherein a portion of the cavity in the toe box region is configured and arranged to provide clearance between the toes and the liner when disposed in the selected elevated orientation.

5. The system as set forth in claim 2, wherein the elevated toe device is an insert that is disposed within a cavity of an inner liner of the boot in the toe box region.

6. The system as set forth in claim 2, wherein the elevated toe device includes an air bladder that raises and lowers within the boot by pneumatic inflation and deflation.

7. The system as set forth in claim 2, wherein the elevated toe device includes a click mechanism and a plurality of inter-engaging slots that allow adjustment of the toe device.

8. The system as set forth in claim 1, wherein the means for adjusting comprises one or more elevated toe devices each elevated toe device being configured and arranged so as to present a different angular orientation relative to a horizontal plane defined by the boot.

9. The system as set forth in claim 2, wherein a surface of the elevated toe device in contact with the toes is configured and arranged so that at least a big toe of a foot of the wearer is positioned at one elevated orientation that is different from another elevated orientation for at least one other toe of the foot.

10. The system as set forth in claim 1, wherein the means for adjusting includes a toe plate and an electric motor, wherein the toe plate is raised and lowered within the boot by the electric motor that is operated by control buttons located on the exterior of the boot.

11. The system as set forth in claim 1, wherein the means for adjusting includes a toe plate and electric motor, wherein the toe plate is raised and lowered within the boot by the electric motor that is operated by a remote control.

12. The system as set forth in claim 1, wherein the elevated orientation being selected is such as to conform to one of the prevailing angle of the slope of the inclined surface being traversed, a predetermined rating of the prevailing slope or an average slope.

13. The system as set forth in claim 1, wherein the elevated orientation being selected is such that the toes are elevated to an angle of one of about 10° or 22.5° or larger with respect to a horizontal plane.

14. The system as set forth in claim 1, wherein the elevated orientation being selected is such that the toes are elevated to an angle in the range of from about 10° to 80° with respect to a horizontal plane.

15. The system as set forth in claim 1, wherein the elevated orientation being selected is such that the toes are elevated to an angle of one of about 10°, 15°, 22.5°, 30°, 45°, 65° or 80° with respect to a horizontal plane.

16. The system of modifying a toe box region of claim 1, wherein:

the boot is configured so as to include an inner liner; and the means for adjusting the toes is arranged so that an elevating portion thereof is disposed between a surface of the inner liner and at least the toes of the wearer.

17. The system of modifying a toe box region of claim 1, wherein:

the boot is configured so as to include an inner liner and an inner sole; and the means for adjusting the toes is arranged so that an elevating portion thereof is disposed between the boot inner sole and an outside surface of the inner liner.

18. The system as set forth in claim 2, wherein the elevated toe device is arranged so that the elevated toe device is disposed between a surface of an inner liner of the boot and at least the toes of the wearer.

19. A system of modifying a toe box region of a boot used by a wearer to traverse an inclined surface, comprising:

a base that is located in the toe box region and configured and arranged to bias the toes of the wearer upwardly into an elevated orientation that is adjusted to conform to the prevailing slope of the inclined surface so as to provide improved control while traversing the declining surface;

wherein the base defines an adjustable plate that moves between a plurality of elevations so as to variably position the toes at a plurality of degrees of elevation with respect to the prevailing angle of the inclined surface; and wherein the adjustable plate is such that the adjustable plate extends less than half the length of the boot.

20. The system as set forth in claim 19, wherein:

the boot further includes a transverse mounted screw mechanism; and wherein the adjustable plate that moves between the plurality of elevations so as to variably position the toes is adjusted by the transverse mounted screw mechanism.

21. The system as set forth in claim 20, wherein the adjustable plate is adjusted by the transverse mounted screw mechanism as it rotated by a wrench interacting with a conforming receiving structure on the screw.

22. A system of modifying a toe box region of a boot used by a wearer to traverse an inclined surface, comprising:

a base that is located in the toe box region;

wherein the toe box region includes a means for adjusting toes of the wearer to a selected one of a plurality of elevated orientations so as to thereby provide improved control while traversing the inclined surface, wherein each of the plurality of elevated orientations being at a different angle and wherein the elevated orientation being selected is such as to conform to a prevailing angle of the slope of the inclined surface being traversed;

wherein the means for adjusting is such that the toes are elevated to one of about or approaching a perpendicular orientation relative to a line of gravity of the prevailing slope of the inclined surface; and wherein the means for adjusting is such that said means extends less than half the length of the boot.

23. The system of modifying a toe box region of claim 22, wherein:

the boot is configured so as to include an inner liner; and the means for adjusting the toes is arranged so that an elevating portion thereof is disposed between a surface of the inner liner and at least the toes of the wearer.

24. The system of modifying a toe box region of claim 22, wherein:

the boot is configured so as to include an inner liner and an inner sole; and the means for adjusting the toes is arranged so that an elevating portion thereof is disposed between the boot inner sole and an outside surface of the inner liner.

* * * * *